United States Patent [19]

Brock et al.

[11] 4,301,905

[45] Nov. 24, 1981

[54] ROTATION SHAFT MACHINE

[75] Inventors: Josef Brock, Viersen; Paul Surkamp, Krefeld, both of Fed. Rep. of Germany

[73] Assignee: Maschinenfabrik Carl Zangs Aktiengesellschaft, Krefeld, Fed. Rep. of Germany

[21] Appl. No.: 77,826

[22] Filed: Sep. 21, 1979

[30] Foreign Application Priority Data

Sep. 22, 1978 [DE] Fed. Rep. of Germany ..... 2841279

[51] Int. Cl.[3] ..... F16D 11/06

[52] U.S. Cl. ..... 192/71; 74/125.5; 192/33 R; 192/93 R

[58] Field of Search ..... 192/28, 33 R, 37, 71, 192/93 R; 74/125.5

[56] References Cited

U.S. PATENT DOCUMENTS 2,858,388 10/1958 Eastman ..... 192/28 X 2,907,432 10/1959 Strickland et al. ..... 192/71

FOREIGN PATENT DOCUMENTS 784968 10/1957 United Kingdom ..... 192/33 R

*Primary Examiner*—Allan D. Herrmann

*Attorney, Agent, or Firm*—Martin A. Farber

[57] ABSTRACT

A rotation shaft machine with a wedge coupling between a drive shaft and an eccentric device for the shaft movement, with which the wedge is mounted in a radially extending recess of an eccentric disc and in two coupling positions which lie diametrically opposite to one another according to a pattern is couplable in and decouplable from an axially extending groove of the drive shaft. The wedge has a groove which is open in the axial direction and at each coupling position there is arranged a switching rod, which is controllable according to the pattern, with a coupling member, the coupling member crossing into the groove of the wedge.

9 Claims, 9 Drawing Figures

Figure 1:
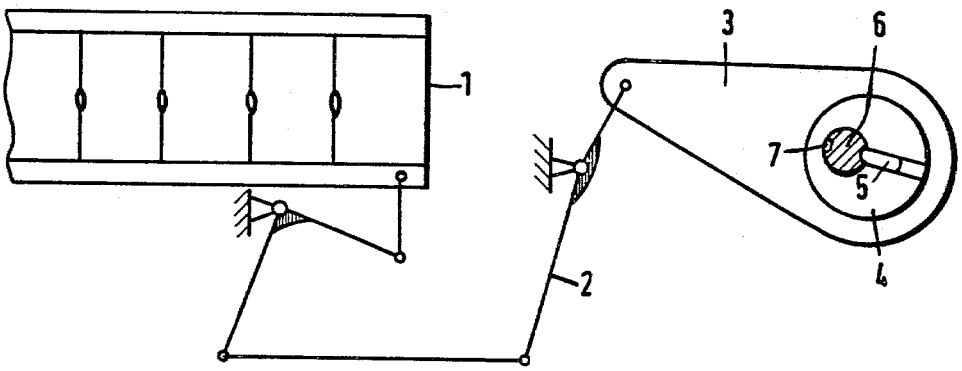

23
22
18
19
10(11)
5b
18
18a
9
8
12
5
7
6
20
20
5a
3
4
19
18
5b
17
15
16
14
15
4
5

IV
23
22
10(11)
19
5b
5b
12'
20
18
4
13
12
5
6
7
IV
8
9
13
5a

ROTATION SHAFT MACHINE

The invention relates to a rotation shaft machine with a wedge coupling between a drive shaft and an eccentric device for the shaft movement, with which the wedge is mounted in a radially extending recess of an eccentric disc and in two coupling positions which lie diametrically opposite to one another according to a pattern or design is couplable in and decouplable out from an axially extending groove of the drive shaft.

From German Pat. Nos. 2,036,643 and 2,036,644 a rotation shaft machine with a v- or wedge coupling of the previously mentioned type is known in which the wedge is guided in the axial and radial direction on a ring or collar which ring is controlled according to a design and in addition is guided in a radial direction on approximately semi-circular guide rails, which guide rails are mounted resiliently on the connecting rod for the shaft movement. With this known wedge coupling the guide rails are moved back and forth with the connecting rod to which they are attached. As a consequence of this relative motion of the guide rails in relation to the pivot axle of the drive shaft, which relative motion is associated with this construction, an exact coupling and uncoupling of the wedge is no longer guaranteed with high rotational speed of the weaving or textile machine.

It is an object of the invention to provide rotation shaft machine with a wedge coupling which guarantees a reliable guiding and stopping of the wedge during the coupling operations and during its rotation even with a high rotational speed.

This task is solved in the manner that the wedge has a groove which is open in the axial direction and at each coupling position there is arranged a switching rod with a coupling member, which coupling member engages in the groove of the wedge, the switching rod being controllable according to a pattern.

In a practical embodiment, the wedge with a shoulder can engage in the recess of the eccentric disc, whereby in the attachment there is provided a blind end bore for a spring, which spring acts upon the wedge in the direction toward the drive shaft, so that the wedge cannot break out in the radial direction during its rotation.

Furthermore it has proven to be advantageous to arrange a ring centrically to the drive shaft, which ring overlaps the wedge in the axial direction and has two radially extending slots, the latter disposed in the coupling areas, in which slots the wedge engages in the uncoupled condition. Thereby the ring with a releaseable arresting can be fixed in its position so that in case of a wrong switching or faulty control it can yield. The arresting means can comprise a spring-biased blocking wedge as well as a friction coupling or a slipping clutch which encircles the ring.

Around the ring a stationary guide ring can be arranged centrically to the drive shaft, which guide ring simultaneously has two pegs, on which pegs the two switching rods with a longitudinal hole are guided.

In another embodiment the arresting means of the wedges in the uncoupled condition can also comprise these overlapping, spring-biased catches.

A rotation shaft machine with a wedge coupling formed according to the invention has the advantage that the wedge is guided in the radial as well as in the axial direction so precisely by machine elements that are not moved relative to the drive shaft that shorter coupling and uncoupling time periods and consequently higher rotational speeds of the textile loom or machine can be achieved.

Figure 2:
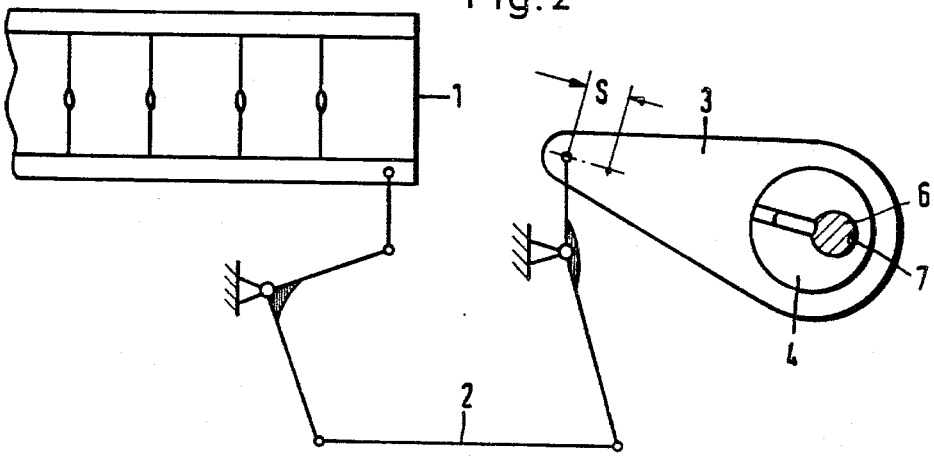
Figure 4:
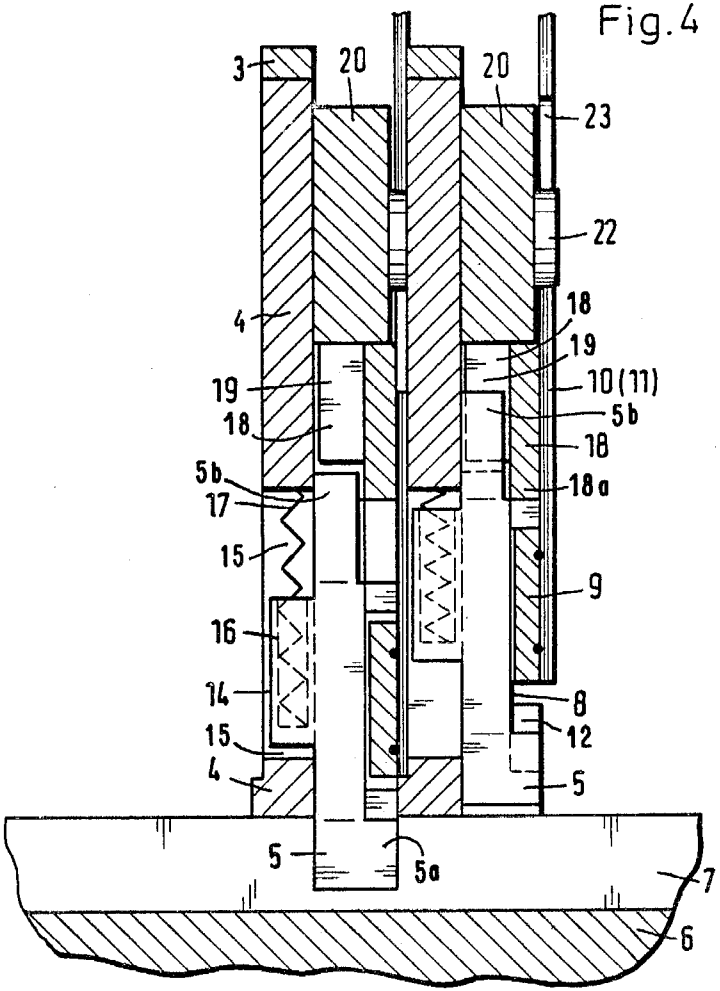
Figure 3:
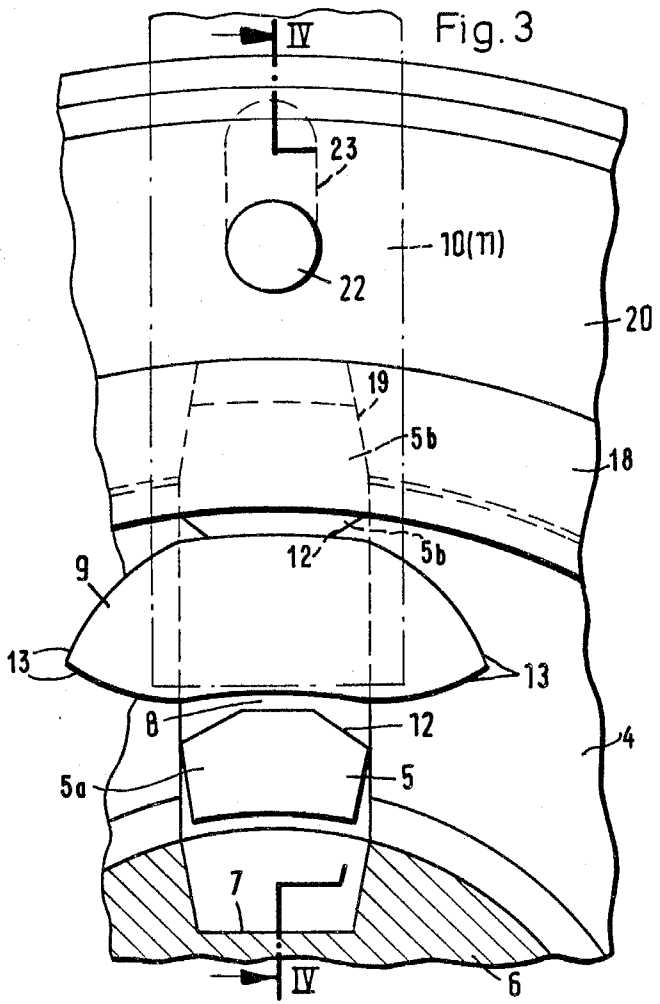
Figure 9:
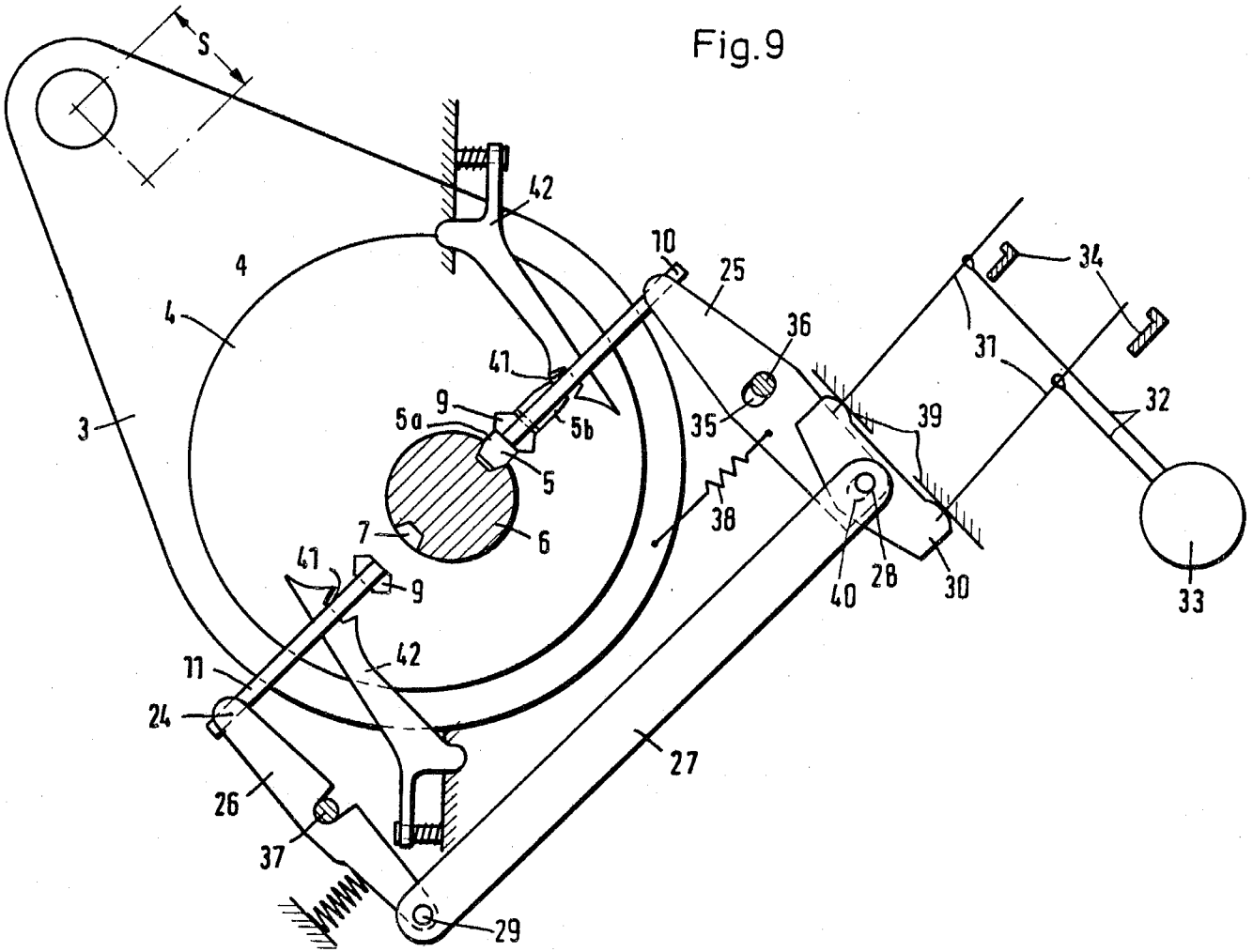

Further details, characteristics, and advantages of the subject matter of the invention will be seen in the description of the accompanying drawings in which preferred embodiments of a rotation shaft machine with a wedge coupling formed according to the invention, are shown schematically in plan views and sections. The drawings show:

FIG. 1 a schematic view of a shaft drive in the bottom shed position;

FIG. 2 a schematic view of a shaft drive in the upper shed position;

FIG. 3 a side view of a vee- or wedge coupling;

FIG. 4 the same wedge coupling with one coupled and one uncoupled wedge, cut along the line IV—IV in FIG. 3;

FIGS. 5–8 schematic drawings in side view of a control device for the wedge coupling for the movement of the shafts from the bottom shed to the upper shed or in the reverse direction and for holding the shafts fixed in the bottom shed or upper shed;

FIG. 9 a schematic illustration of a side view of another embodiment of the wedge coupling.

A shaft 1 is moved via a transmission or gearing 2 from the bottom shed position (shown in FIG. 1) into the upper shed position (shown in FIG. 2) or in the reverse order by a connecting rod 3, which rod 3 is mounted on an eccentric disc 4. For this purpose the eccentric disc 4 can be coupled with a drive shaft 6 by means of a radially displaceably arranged wedge 5, which shaft 6 has two axially extending grooves 7 for the engagement of a first part 5*a* of the wedge 5, the grooves 7 being diametrically opposite to each other. The eccentric disc 4 which is coupled with the drive shaft 6 by means of the wedge 5 moves the connecting rod 3 upon a half rotation by the path s from the bottom shed position into the upper shed position or in the reverse order. The wedge 5 has a groove 8 that is open in the axial direction, into which groove 8 a coupling member 9 engages 7. One coupling member 9 is attached on each of the ends of two switching rods 10 and 11, the switching rods 10 and 11 being diametrically opposite to each other and controllable according to a pattern or design. The entrance and exit of the groove 8 in the wedge 5 are provided with bevelled or inclined surfaces 12, whereas the ends of the coupling member 9 are provided with cam surfaces 13 in order to guarantee a disturbance-free up and down movement of the wedge 5.

Each wedge 5 on its rear side is provided with an attachment or shoulder 14, which shoulder 14 engages in a radially extending recess 15 of the eccentric disc 4, the shoulder 14 being provided with a blind end bore or blind hole 16 into which bore 16 a compression spring 17 is inserted. The wedge 5 is biased by the compression spring 17 in the direction toward the groove 7 of the drive shaft 6 and during its rotation is pressed into the groove 7.

After the arrival of a coupled wedge 5 into the coupling area, by means of coupling element 9 the wedge 5 is pulled from out of the groove 7 of the drive shaft 6 in opposition to the action of the compression spring 17 and therewith is uncoupled. The coupling of the wedge 5 in the groove 7 of the drive shaft 6 occurs by means of a correspondingly reversed stroke of the coupling element 9 and by means of the compression spring 17.

Above the wedge 5 a ring 18 is arranged concentrically to the drive shaft 6, which ring 18 has in the vicinity of the two switching rods 10 and 11, two axially extending slots 19, in which slots 19 the outer end second part 5*b* of the wedge 5 engages in the decoupled position. The ring 18 with an overlapping radially inwardly directed annular projection 18*a* overlaps the outer end of the wedge 5 even still in the coupled position, so that an axial displacement of the wedge 5 is impossible even during its rotation.

The ring 18 is fixed in its normal operating position by means of a spring-laoded locking or blocking wedge 21, but is rotatably mounted in a fixed or stationary guide ring 20, so that in the case of a wrong switching or faulty control in which the wedge 5 still extends partially into the slot 19 the ring 18 is able to yield in the and rotate there-along in the circumferential direction.

Pins or pegs 22 are attached to the guide ring 20, on which pegs 22 the switching rods 10 and 11 are guided with, respectively, one longitudinal hole 23 each.

The two switching rods 10 and 11 are connected at their outer ends with two control levers 25 and 26 via pins 24, which control levers in their turn are connected with each other via a coupling rod 27 and pivot axles 28 and 29.

A balance lever 30, to which lever 30 two pressing needles 31 are articulated, engages on the pivot axle 28 of the control lever 25. The pressing needles 31 are in connection with sensing needles 32, which needles 32 sense a paper card (not illustrated), the card being moved by a card cylinder 33. A hole in the paper card signifies that the sensing needles 32 fall in and shift the pressing needles 31 into the movement path of sliding rails or pressure guides 34.

The control lever 25 is formed with an oblong hole 35 and is mounted thereat on a control axle 36, which axle 36 is moved back and forth in rhythm together with the pressure rails 34. The control lever 26 on the other hand is mounted on a fixed or stationary pivot axle 37. Both control levers 25 and 26 are pulled into their starting position by tension or draw springs 38.

Figure 5:
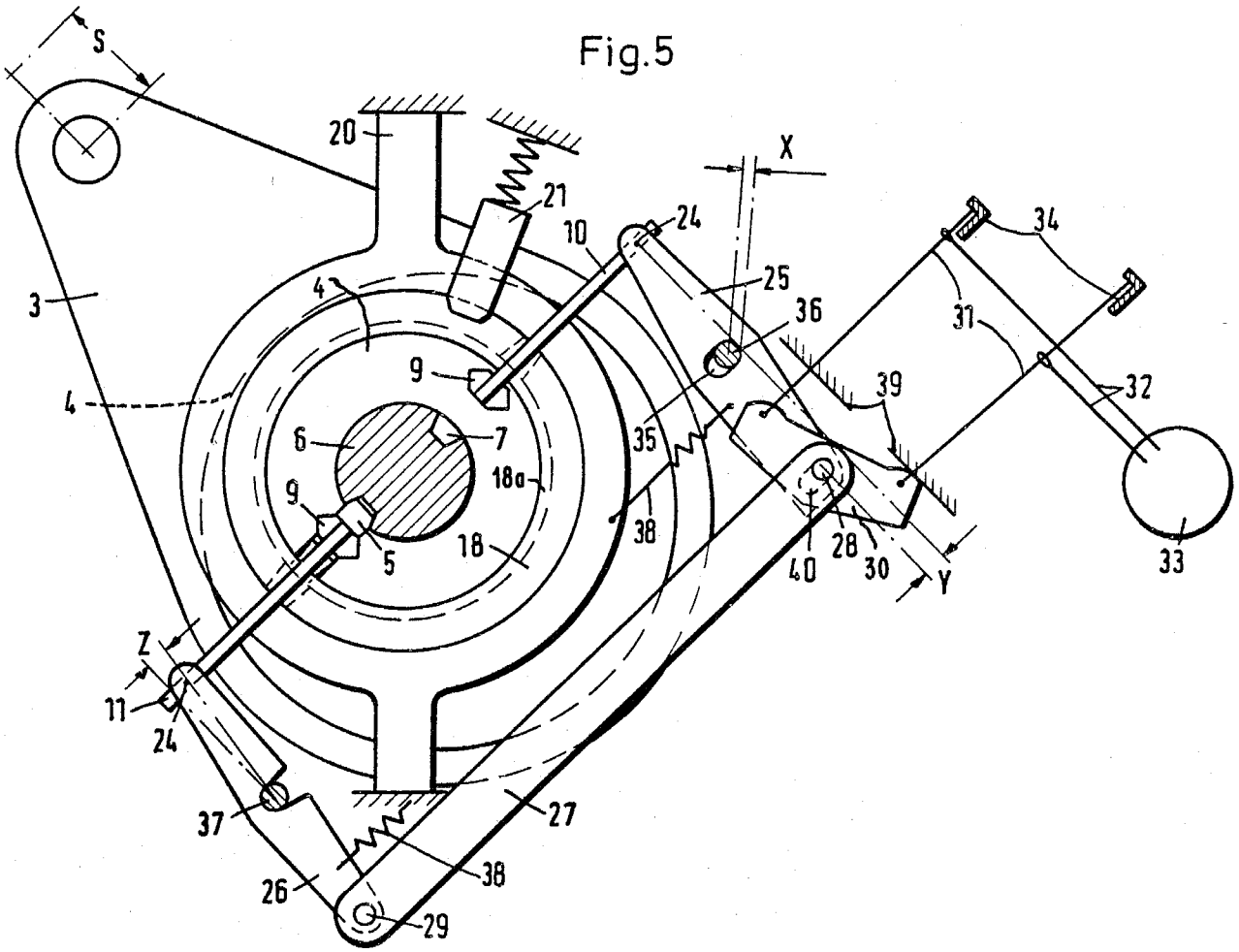

The control device for a wedge coupling formed according to the invention, shown in FIGS. 5 to 8, is very simple in its construction and operates as follows:

With the lower shed position shown in FIG. 5, the sensing needles 32 have found a hole in the paper card, so that the pressure needles 31 have lifted the balance lever 30 off a support 39 and thereby have displaced the pivot axle 28 by the path y, which path y, via the coupling rod 27 and the control lever 26, produces a coupling path Z at the pin 24 of the switching rod 11 since the control lever 26 pivots about the fixed pivot axle 37, so that the wedge 5 has become coupled in the groove 7 of the drive shaft 6.

No coupling path z has been produced on the pin 24 of the other switching rod 10 because the control axle 36 was displaced by the path x simultaneously with the pressure rail guides 34.

Figure 6:
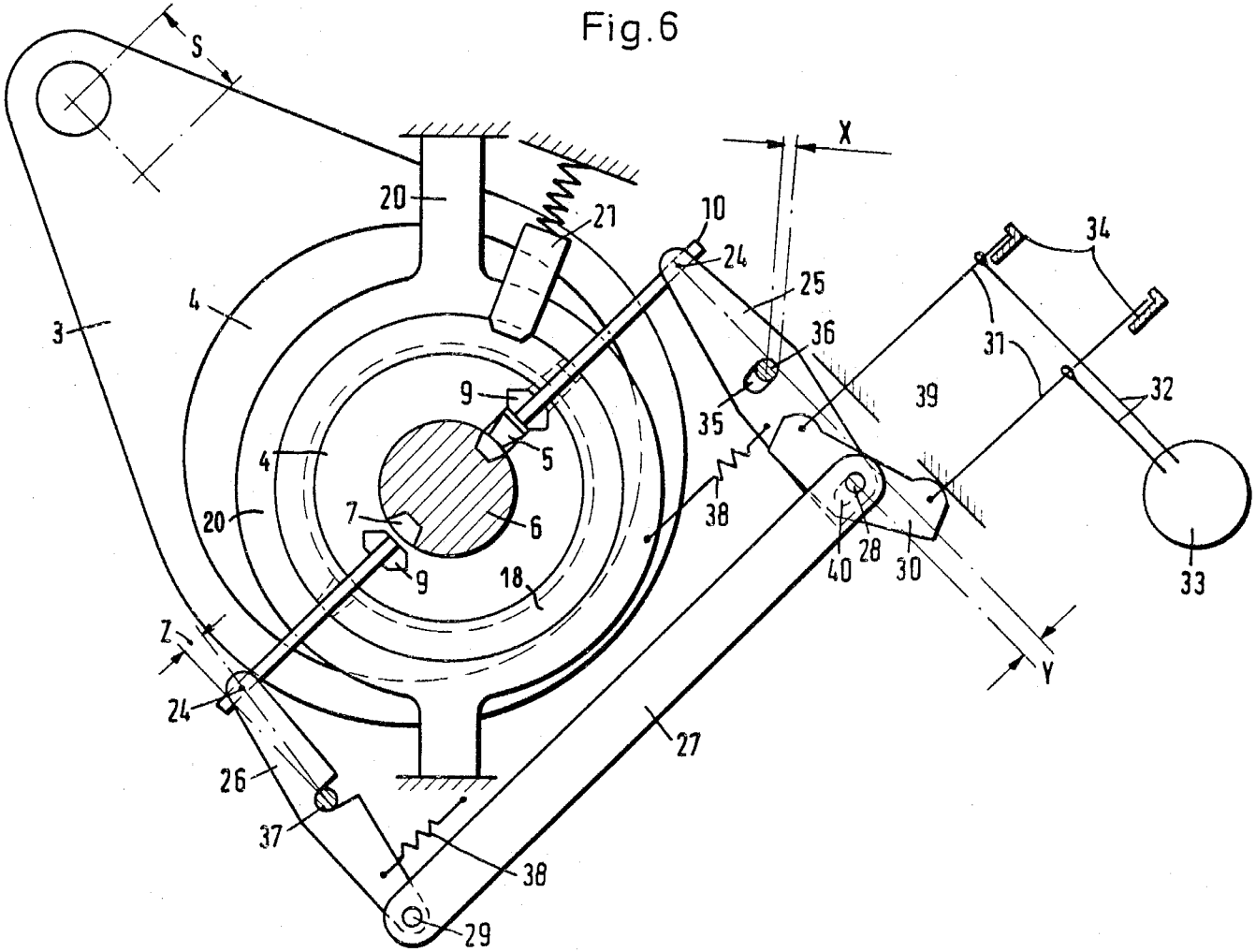

In the upper shed position shown in FIG. 6, after a one-half rotation of the eccentric disc 4, the wedge 5 ran up on the coupling member 9 of the switching rod 10 and was uncoupled from the groove 7 in the drive shaft 6. The control position shown in FIGS. 5 and 6 signifies at the same time that a wedge 5, uncoupled by the switching rod 10, is not coupled, thus the shaft should stay in its upper shed position.

Figure 7:
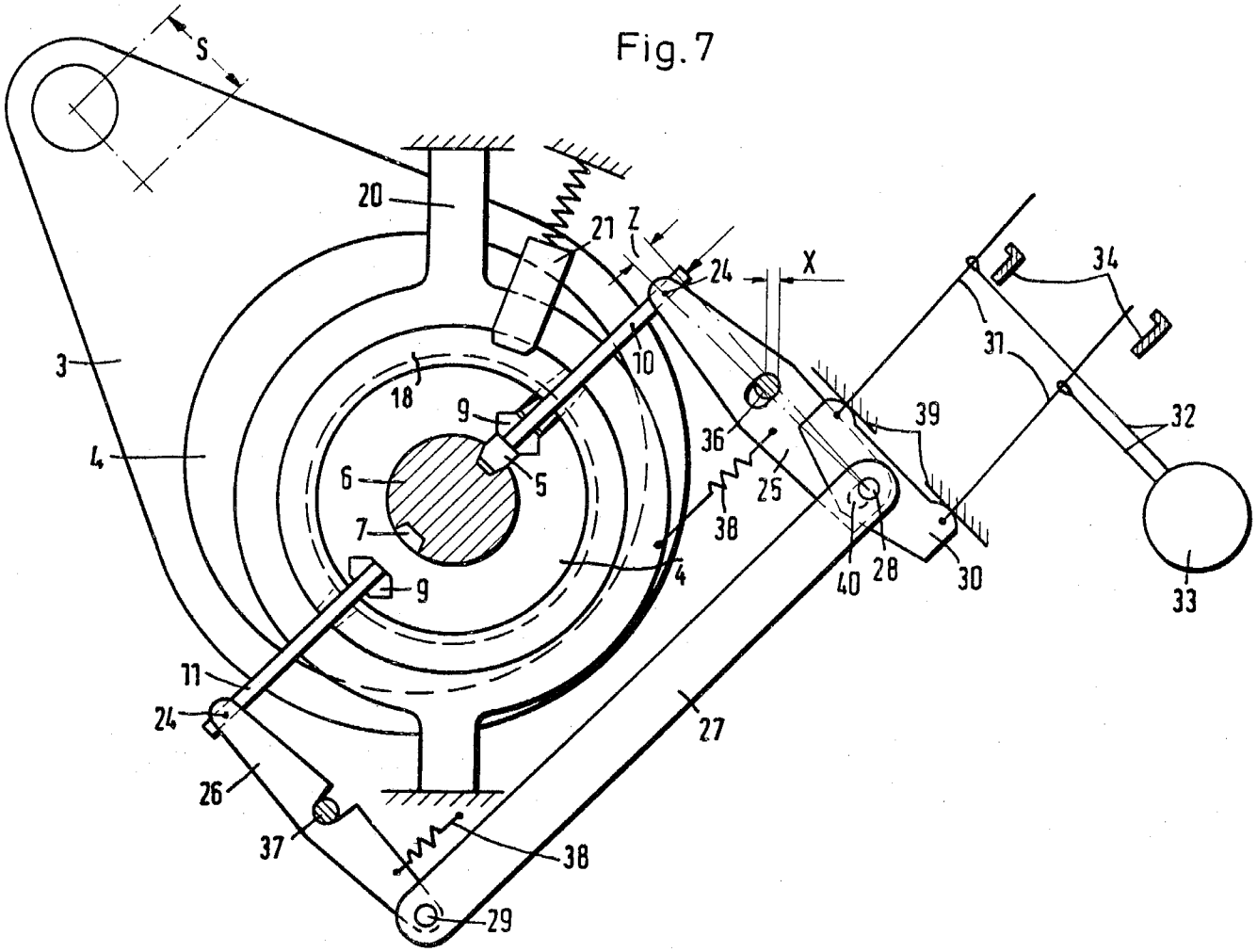
Figure 8:
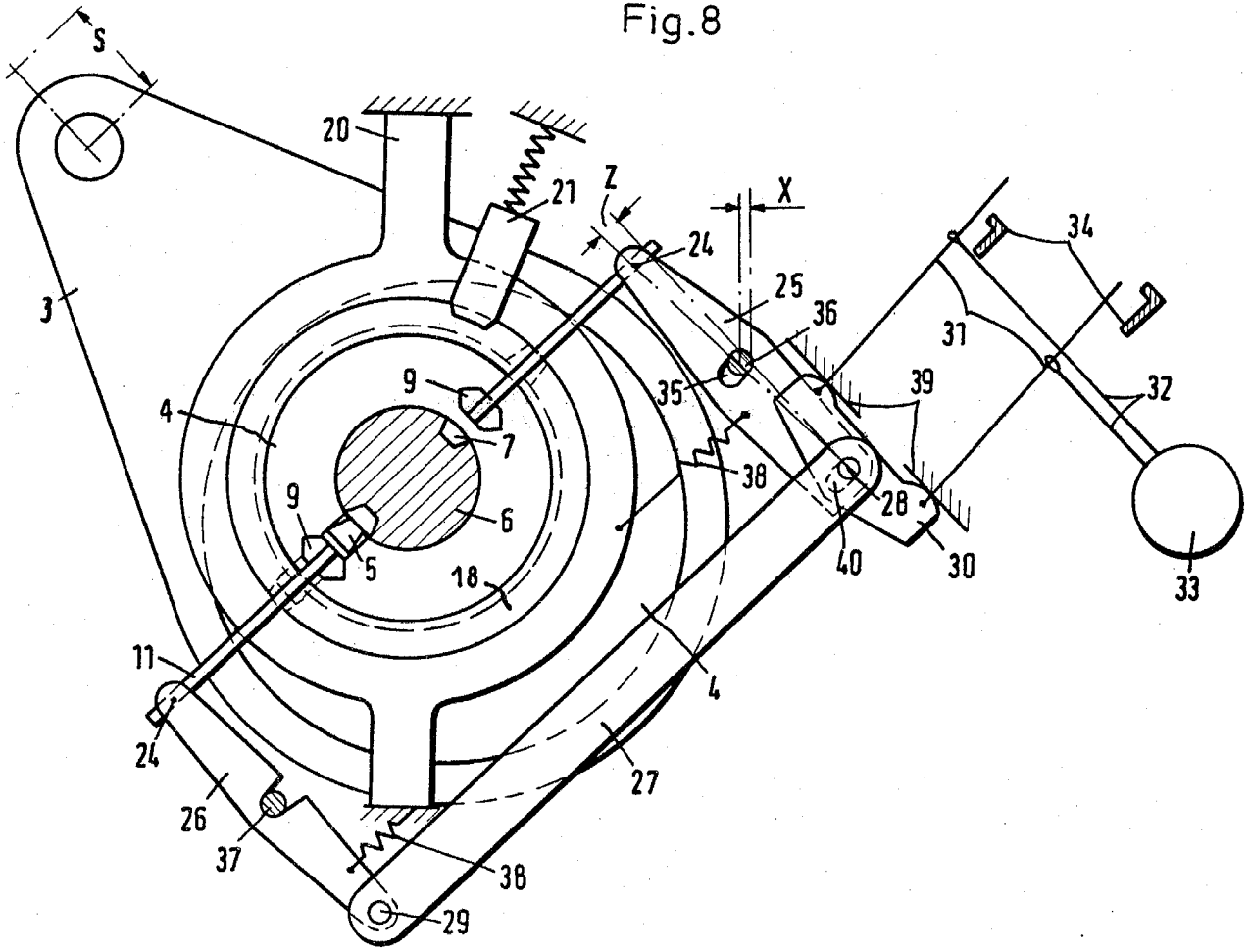

In the upper shed position shown in FIG. 7 the sensing needles 32 have found no hole in a paper card, so that the pressing needles 31 thus do not project into the path of movement of the pressing rails or pressure guides 34 and therefore are not pressed or driven out. The balance lever 30 remains in abutment on its supports 39, so that the pivot axle 28 also is not displaced. Since however the control axle 36 of the control lever 25 was displaced by the path x during standstill of the pivot axle 28, a coupling path z is produced on the pin 24 of the switching rod 10, so that the wedge 5 is again coupled into the groove 7 of the drive shaft 6. Upon a half rotation of the eccentric disc 4 the shaft is moved again from the upper shed position shown in FIG. 7 to the control position shown in FIG. 8. The control position shown in FIG. 8 signifies at the same time that the shaft 1 remains in the bottom shed position since the wedge 5 no longer couples the drive shaft 6 to the eccentric disc.

For the equalization or compensation of manufacturing tolerances, and for the avoidance of jammings in the control, the control 25 is formed with an oblong hole 40 and is mounted thereat on the pivot axle 28.

In FIG. 9 a different embodiment of a wedge coupling created according to the invention is shown, in which the ring 18 and the stationary guide ring 20 are omitted in the drawings and not necessary. The outer end 56*b* of the uncoupled wedge 5 is able to engage or catch in a recess 41 of resilient pawls or detents 42. Otherwise the drive and control remain unchanged.

All new features mentioned in the description and shown in the drawings are important to the invention, including insofar as they have not been claimed in the following claims.

What is claimed is:

1. In a rotation shaft machine with a wedge coupling between a drive shaft and an eccentric device for the shaft movement, with which the wedge is mounted in a radially extending recess of an eccentric disc and in two coupling positions which lie diametrically opposite to one another according to a pattern is couplable in and decouplable out from an axially extending groove of the drive shaft. the improvement wherein the wedge is formed with a groove which is open in the axial direction, a switching rod having a coupling member and disposed at each of the coupling positions, said coupling member overlapping into said groove of the wedge, the switching rod constituting means for being controllable according to the pattern.

2. The shaft machine according to claim 1, further comprising two spring-biased pawls, said pawls in an uncoupled condition of the wedge relative the groove of the drive shaft overlap said wedge, respectively.

3. The shaft machine according to claim 1, wherein said wedge includes a first part engageable with said groove of the drive shaft and a second part constituting engagement means in an uncoupled condition of the wedge relative to the groove of the drive shaft, said first part and said second part are separated by said groove of the wedge.

4. The shaft machine according to claim 1, wherein said drive shaft is formed with two of said axially extending groove diametrically opposite to each other.

5. The shaft machine according to claim 1, further comprising a ring formed with two radially extending slots, said slots are disposed in said coupling positions, said wedge engages in said slots, respectively, in an uncoupled condition of the wedge relative the drive shaft groove, said ring is arranged concentrically to the drive shaft and overlaps said wedge in the axial direction.

6. The shaft machine according to claim 5, further comprising a releasable detent means for fixing said ring in an operating position.

7. The shaft machine according to claim 6, wherein said detent means comprises a spring-loaded blocking wedge.

8. The shaft machine according to claim 6, further comprising a stationary guide ring, said first-mentioned ring is mounted in said stationary guide ring.

9. The shaft machine according to claim 8, further comprising pegs are connected to said guide ring, each said switching rod is formed with a longitudinal hole guided on one of said pegs, respectively.

* * * * *

UNITED STATES PATENT AND TRADEMARK OFFICE

CERTIFICATE OF CORRECTION

PATENT NO. : 4,301,905

DATED : November 24, 1981

INVENTOR(S) : Josef Brock, et al

It is certified that error appears in the above—identified patent and that said Letters Patent is hereby corrected as shown below:

Figure 3 should appear as shown on the attached sheet:

Signed and Sealed this

*Eighteenth* Day of *May 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,301,905

DATED : November 24, 1981

INVENTOR(S) : Josef Brock, et al

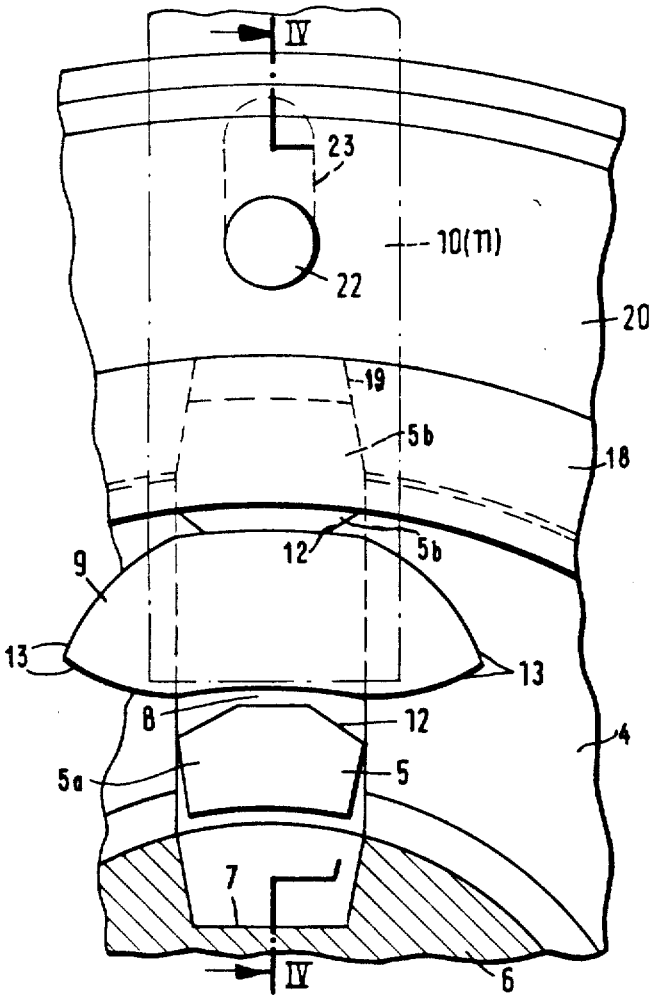

It is certified that error appears in the above—identified patent and that said Letters Patent is hereby corrected as shown below: